US011441262B2

(12) United States Patent
Nakagawa et al.

(10) Patent No.: US 11,441,262 B2
(45) Date of Patent: Sep. 13, 2022

(54) FORGERY-PREVENTING THREAD/YARN

(71) Applicant: Nakagawa Sangyo Co., Ltd., Komatsu (JP)

(72) Inventors: Yoshikatsu Nakagawa, Komatsu (JP); Naoki Ikegami, Tokyo (JP)

(73) Assignee: NAKAGAWA SANGYO CO., LTD., Komatsu (JP)

( * ) Notice: Subject to any disclaimer, the term of this patent is extended or adjusted under 35 U.S.C. 154(b) by 774 days.

(21) Appl. No.: 14/927,139

(22) Filed: Oct. 29, 2015

(65) Prior Publication Data

US 2016/0194823 A1 Jul. 7, 2016

(30) Foreign Application Priority Data

Jan. 5, 2015 (JP) ..... JP2015-000071

(51) Int. Cl.
*B42D 25/30* (2014.01)
*D06P 1/00* (2006.01)
(Continued)

(52) U.S. Cl.
CPC ..... *D06P 1/0012* (2013.01); *B42D 25/30* (2014.10); *B42D 25/355* (2014.10); *D02G 3/06* (2013.01);
(Continued)

(58) Field of Classification Search
CPC ..... B42D 25/30; B42D 25/355; D02G 3/06; D06M 2101/30; D06M 23/00;
(Continued)

(56) References Cited

U.S. PATENT DOCUMENTS 4,618,167 A * 10/1986 Whitehead ..... D02G 3/12 283/57
5,314,739 A * 5/1994 Teodoro Vidal ..... D21H 21/42 428/195.1
(Continued)

FOREIGN PATENT DOCUMENTS

EP 1873284 1/2008
GB 2250473 6/1992
(Continued)

OTHER PUBLICATIONS

Ottway (GB 1 095 286).*
European Patent Office; Search Report for EP 15193357; dated May 9, 2016; Munich, Germany.

*Primary Examiner* — Holly Rickman
*Assistant Examiner* — Linda N Chau
(74) *Attorney, Agent, or Firm* — Dickinson Wright PLLC; Andrew D. Dorisio

(57) ABSTRACT

According to the present invention, there is provided, at low cost, a thread/yarn for making it possible to easily determine whether a product is a genuine product or a forgery/imitation product, thereby suppressing the manufacture and marketing of forgery/imitation products. This forgery-preventing thread/yarn is formed by making use of a film comprising abase sheet and letters or images printed on the base sheet, the film being slit to have a width of 0.15 mm~0.75 mm. A thread, yarn or a flat thread representing a genuine product can be cheaply manufactured since it can be obtained by simply slitting a film to a width of 0.15 mm~0.75 mm. Further, it is possible to easily determine whether a product is a genuine product or a forgery/imitation.

14 Claims, 2 Drawing Sheets

(51) Int. Cl.

| | |
|---|---|
| ***D02G 3/06*** | (2006.01) |
| ***B42D 25/355*** | (2014.01) |
| ***D02G 3/44*** | (2006.01) |
| ***D06P 3/52*** | (2006.01) |
| ***D06P 3/60*** | (2006.01) |
| ***D06P 3/24*** | (2006.01) |
| *G09F 3/02* | (2006.01) |
| *D06M 101/30* | (2006.01) |

(52) U.S. Cl.
CPC ..... *D02G 3/44* (2013.01); *D06P 3/24* (2013.01); *D06P 3/52* (2013.01); *D06P 3/60* (2013.01); *D06M 2101/30* (2013.01); *G09F 2003/0276* (2013.01); *G09F 2003/0282* (2013.01)

(58) Field of Classification Search
CPC ..... D06M 23/16; G09F 2003/0276; G09F 2003/0282; D06P 1/0012; D06P 3/24; D06P 3/52; D06P 3/60; D06P 5/30
See application file for complete search history.

(56) References Cited

U.S. PATENT DOCUMENTS

| | | | | |
|---|---|---|---|---|
| 6,592,716 | B1 * | 7/2003 | Kim | D21H 15/04 162/140 |
| 7,338,709 | B1 * | 3/2008 | Wada | D02G 3/02 428/364 |
| 2008/0129036 | A1 * | 6/2008 | Seki | D21H 21/42 283/67 |

FOREIGN PATENT DOCUMENTS

| | | | |
|---|---|---|---|
| JP | 1992263697 | | 9/1992 |
| JP | 2002170078 | A | 6/2002 |
| JP | 2007-092254 | A | 4/2007 |
| JP | 2007523361 | | 8/2007 |
| JP | 2008111203 | A | 5/2008 |
| JP | 2008169508 | A | 7/2008 |
| WO | WO9945200 | | 9/1999 |

* cited by examiner

FORGERY-PREVENTING THREAD/YARN

TECHNICAL FIELD

This invention relates to a thread/yarn for making it possible to determine whether or not a product is a genuine product.

BACKGROUND ART OF THE INVENTION

Due to the presence of forgeries and imitations, the manufactures and dealers of genuine products are receiving enormous damages. These forgeries and imitations have become increasingly sophisticated in appearance year by year due to the development of technology and therefore even the experts frequently feel it difficult to determine the authenticity of products. When the presence of such forgeries and imitations is spread in the market, it would be resulted not only in the decrease of the earning of genuine products but also in a loss of reliability with respect to the quality of genuine products.

With respect to the countermeasures for preventing such forgeries and imitations, there has been developed a forgery-preventing label formed using a thread/yarn which is capable of developing colors as it is irradiated with ultraviolet ray or infrared ray as disclosed for example in Japanese Patent Application Publication (Kokai) No. 2007-92254. Since this forgery-preventing label develops no color even if it is irradiated with visible light, it would be difficult for the manufactures and dealers of such forgeries and imitations to notice the employment of the thread which develops a color as it is irradiated with ultraviolet ray or infrared ray.

The invention disclosed in the above Japanese Patent Application Publication however is accompanied with a problem that it is impossible to determine whether a product is a genuine product or a forgery/imitation unless the product is examined by making use of ultraviolet/infrared-irradiating means. As a matter of fact, it is unlikely that an end consumer always carries with him such ultraviolet/infrared-irradiating means as he wants to buy a product.

Further, there is also a problem that due to the development of the manufacturing technology of forgery/imitation products, it is now possible for manufacturers of forgery/imitation products to manufacture even a forgery-preventing label which is formed using a thread which is capable of developing colors as it is irradiated with ultraviolet ray or infrared ray, thereby making it more difficult to determine to discriminate a genuine product from a forgery/imitation product.

Furthermore, when a cat-and-mouse game is brought about between authentic manufacturers or distributors of genuine products and unauthorized manufacturers or distributors of forgery/imitation products, it will necessitates the increase of cost for taking measures for preventing forgery/imitation products, thereby possibly giving rise to an increase in price of genuine products.

BRIEF SUMMARY OF THE INVENTION

In view of solving the aforementioned problems and for the purposes of suppressing the manufacture and marketing of forgery/imitation products, an object of the present invention is to provide, at low cost, a thread/yarn for making it possible to determine whether a product is a genuine product or a forgery/imitation product.

In order to solve the aforementioned problems, the present invention provides a forgery-preventing thread formed of a film comprising a base sheet and letters or images printed on the base sheet, the film being slit to have a width of 0.15 mm~0.75 mm.

According to one embodiment of the present invention, there is also provided a forgery-preventing yarn which is formed of a flat thread and a core thread/yarn, wherein the flat thread is formed of a film comprising a base sheet and letters or images printed on the base sheet, the film being slit to have a width of 0.15 mm~0.75 mm, and the flat thread is twisted to the core thread/yarn. In the present specification and claims, the "core thread/yarn" means that it may be twisted itself or not twisted.

According to the forgery-preventing thread of the present invention described above, since the forgery-preventing thread/yarn is formed of a film which is slit to have a width of 0.15 mm~0.75 mm and carries information certifying the authenticity of a product, these thread, yarn and flat thread can be manufactured at a low cost. Further, since camera built-in electronic devices have become popular among consumers nowadays, it is possible for the consumers to easily determine whether a product is a genuine product or a forgery/imitation by magnifying the thread/yarn by making use of the camera attached to the electronic devices. Since it is possible for the consumers themselves to easily determine whether a product is a genuine product or a forgery/imitation, it may be possible to suppress the manufacture and marketing of forgery/imitation products.

According to another embodiment of the present invention, the aforementioned letters or images formed on the base sheet are printed at a prescribed line width depending on the kinds of printing method.

According to a further embodiment of the present invention, the aforementioned letters or images printed on the forgery-preventing thread/yarn may be depicted as thin line width as possible depending on the method of printing and as long as they are identifiable.

According to a further embodiment of the present invention, the aforementioned letters or images printed on the forgery-preventing thread/yarn are depicted by a straight line/straight lines which is/are parallel with, perpendicular to, inclined by 45 degrees to the feeding direction of the base sheet on an occasion of printing the letters or images, or by a combination of these lines.

According to the forgery-preventing thread of the present invention described above, since the letters or images are constituted by any of these straight lines, it is possible to secure a sufficient space between the straight lines constituting the letters or images even if the letters or images are minimized, thereby making it possible to prevent the letters or images from being collapsed on the occasion of printing these letters or images and hence to easily identify the letters or images.

According to a further embodiment of the present invention, a protective layer may be deposited on a surface of the base sheet where the letters or images are printed.

According to the forgery-preventing thread/yarn of the present invention described above, since a protective layer is deposited to cover the letters or images, it is possible to prevent the printed letters or images from being worn away even if the thread, yarn or flat thread is rubbed.

According to a further embodiment of the present invention, an ink to be used for printing the letters or images, the protective layer or an adhesive layer to be used for adhering the protective layer to the film may be respectively enabled to exhibit fluorescence.

According to the forgery-preventing thread/yarn of the present invention described above, it is possible to provide information of authenticity of product from the emission of fluorescence if any ultraviolet/infrared-irradiating means is available to use. Further, when the manufacturers or distributors of forgery/imitation products mistake the emission of florescence from the thread as indicating the authenticity of product, the manufacturers or distributors of forgery/imitation products may possibly overlook the existence of the printed letters or images on the thread/yarn. In such a case, the existence of the printed letters or images on the thread/yarn would become more effective in the determination of whether a product is a genuine product or a forgery/imitation.

According to the present invention described above, it is now possible to manufacture, at a low cost, a forgery-preventing thread/yarn which makes it possible to easily determine whether a product is a genuine product or a forgery/imitation product, while suppressing the manufacture and marketing of forgery/imitation products.

DETAILED DESCRIPTION OF THE INVENTION

Next, the forgery-preventing thread 1 according to one embodiment of the present invention will be explained as follows.

Figure 1:
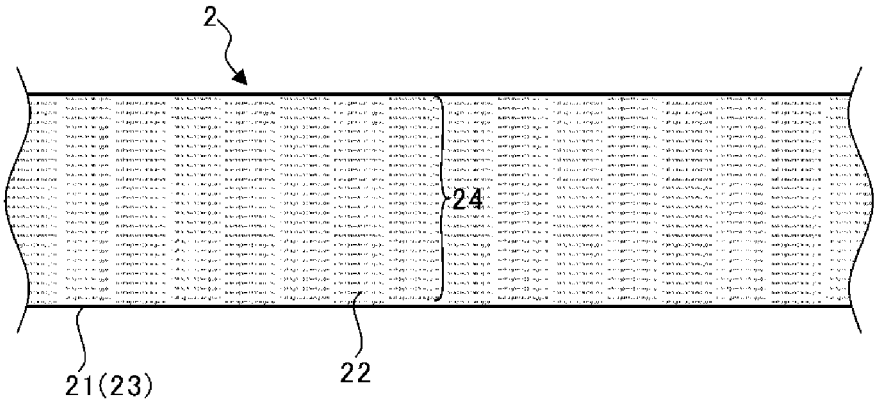
FIG. 1 is a plan view of a film for manufacturing a forgery-preventing thread/yarn according to one embodiment of the present invention.

As shown in FIG. 1, a film 2 for manufacturing a forgery-preventing thread 1 comprises a base sheet 21 which is made of a synthetic resin such as polyester, nylon, etc. and letters or images 22 which are printed on the base sheet 21. Although this embodiment will be illustrated in a case where the base sheet 21 is made of a synthetic resin, the present invention is not limited to such a case but may cover various cases where the base sheet is formed of a film (rayon film etc.) or web to be manufactured using plants as a raw material, the base sheet is formed of a biodegradable biomass film or sheet which can be derived from natural products, or the base sheet is formed of paper which is capable of withstanding the environment of use.

The letters or images 22 can be printed on the base sheet 21 at a predetermined line width depending on the kinds of printing method. In the printing method of this embodiment, the lower limit of the line width is set to 0.03 mm. Incidentally, depending on the printing method, it is possible to set the line width to less than 0.03 mm. With respect to the printing method, it is possible to employ any kind of methods such as screen printing, gravure printing, offset printing, flexographic printing, inkjet printing, digital printing, etc. With respect to the ink to be used, the solvent thereof may be aqueous or oleaginous. The colorant for the ink may be a dye or a pigment.

On the occasion of slitting the film 2 to be explained hereinafter, a column 24 of letters or images 22 lined up at right angle (the vertical direction in FIG. 1) to the slitting direction (the lateral direction in FIG. 1) is somewhat shifted relative to the neighboring column 24 of letters or images 22 in the direction of right angle (the vertical direction in FIG. 1). The reason for doing this is that in the step of slitting the film 2 to be explained hereinafter, at least a portion of the letters or images 22 for easily determining whether a product is a genuine product or a forgery/imitation can be unfailingly displayed on the surface of the forgery-preventing thread 1 even when the line width of slitting is changed. With respect to the printing of the letters or images 22, it is not restricted to the embodiment shown in FIG. 1, but it can be variously modified as long as at least a portion of the letters or images 22 for easily determining whether a product is a genuine product or a forgery/imitation is displayed on the surface of the forgery-preventing thread 1 which has been slit. For example, the letters or images may be printed in the direction diagonal to the direction of slitting, or they may be printed at random without accompanying any regularity.

Figure 2:
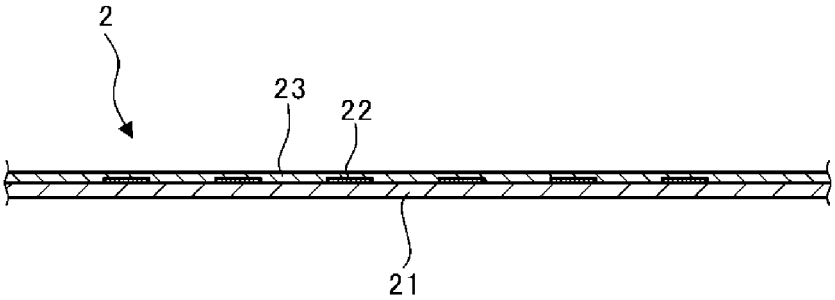
FIG. 2 is a schematic sectional view of the film shown in FIG. 1.

As shown in FIG. 2, a protective layer 23 may be formed on the surface of the base sheet 21 where the letters or images 22 have been printed. This protective layer 23 may be formed on the letters/images-printed surface of the base sheet 21 by means of coating or by making use of an adhesive layer which can be interposed between the protective layer 23 and the letters/images-printed surface of the base sheet 21.

The ink to be used for printing the letters or images 22, the protective layer 23 which is formed of a coating or a protective film, or the adhesive layer to be used for adhering the protective layer 23 to the base sheet 21 may be created so as to enable them to exhibit fluorescent property, phosphorescent property or ultraviolet-reflecting property against an electromagnetic wave having a specific wavelength such as ultraviolet ray, infrared ray, etc.

Figure 3:
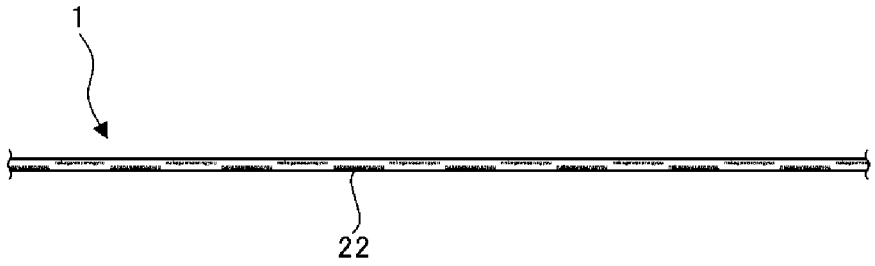
FIG. 3 is a plan view of the thread which has been slit from the film of FIG. 1.

When the film 2 is slit at a line width of 0.15 mm~0.75 mm, the forgery-preventing thread 1 shown in FIG. 3 can be obtained. On the surface of the forgery-preventing thread 1, there are displayed the letters or images 22 that have been printed thereon. Although the film 2 that has been slit may be used as it is as a forgery-preventing thread 1, a plurality of the films 2 that have been slit may be twisted together, thereby creating a combined forgery-preventing thread or a yarn. Otherwise, the flat thread that has been slit from the film 2 may be twisted to a core thread/yarn in various ways which are known in the art for example such as Maru twisting, Jabara twisting, Hagoromo twisting, Tasuki twisting, Karami twisting, Buriyan twisting, etc. or by way of a round twisting, a pleated twisting, a feather twisting, a diagonal twisting, a leno twisting to thereby form a forgery-preventing yarn.

Figure 4:
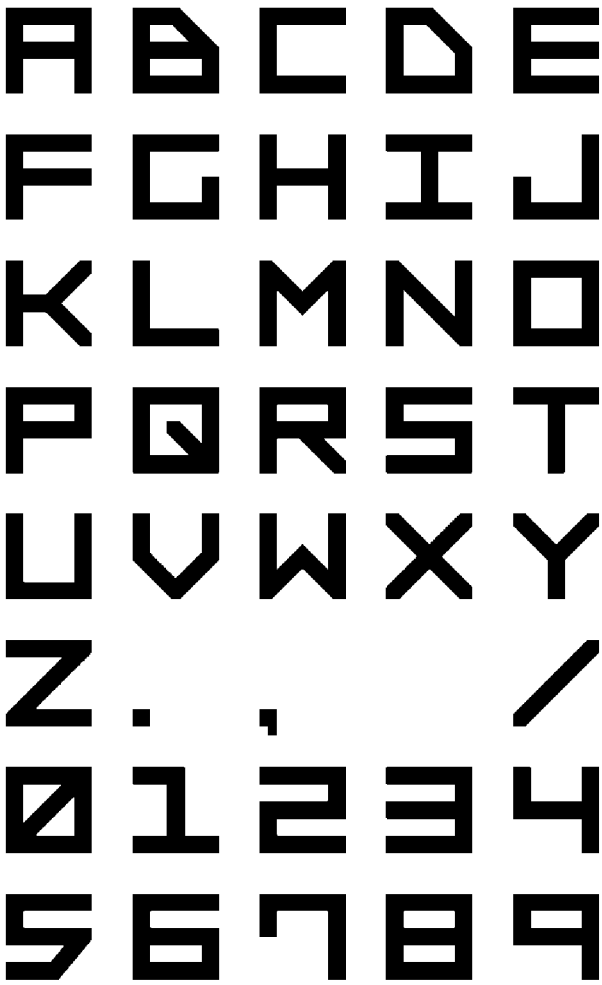
FIG. 4 is an enlarged view of printed letters.

As one example of letters to be printed on the film 2, FIG. 4 shows an image consisting of alphabets, symbols and numbers, each representing examples of letters to be actually printed on the base sheet and being magnified 100 times. These letters are constituted by a straight line/straight lines which is/are parallel with, perpendicular to, inclined by 45 degrees to the feeding direction of the base sheet 21 in the printing process thereof, or by a combination of these lines.

What is claimed is:

1. A forgery-preventing yarn comprising a flat forgery-preventing thread formed of a film comprising a base sheet and letters or images printed on the base sheet, the film being slit to have a width of 0.15 mm to 0.75 mm, wherein the flat forgery-preventing thread is twisted to a core thread/yarn, and wherein the letters or images are exposed upon twisting of the flat forgery-preventing thread to the core thread/yarn;

wherein all of the letters or images printed on the base sheet are depicted only by a straight line/straight lines which is/are parallel with, perpendicular to, inclined by 45 degrees to the feeding direction of the base sheet on an occasion of printing the letters or images, or by a combination of these lines.

2. The forgery-preventing yarn according to claim 1, wherein the letters or images printed on the base sheet is depicted at a predetermined line width depending on the method of printing.

3. The forgery-preventing yarn according to claim 1, wherein an ink to be used for printing the letters or images is enabled to exhibit fluorescent property, phosphorescent property or ultraviolet-reflecting property.

4. The forgery-preventing yarn according to claim 2, wherein an ink to be used for printing the letters or images is enabled to exhibit fluorescent property, phosphorescent property or ultraviolet-reflecting property.

5. The forgery-preventing yarn according to claim 1, wherein an ink to be used for printing the letters or images is enabled to exhibit fluorescent property, phosphorescent property or ultraviolet-reflecting property.

6. A forgery-preventing yarn comprising:

a flat forgery-preventing thread formed of a film comprising a base sheet and letters or images printed on the base sheet, the film being slit to have a width of 0.15 mm to 0.75 mm, wherein the flat forgery-preventing thread is twisted to a core thread/yarn, wherein the letters or images are printed in a direction diagonal to a direction of slitting;

wherein all of the letters or images printed on the base sheet are depicted only by a straight line/straight lines which is/are parallel with, perpendicular to, inclined by 45 degrees to the feeding direction of the base sheet on an occasion of printing the letters or images, or by a combination of these lines.

7. The forgery-preventing yarn according to claim 6, wherein the letters or images printed on the base sheet is depicted at a predetermined line width depending on the method of printing.

8. The forgery-preventing yarn according to claim 6, wherein a protective layer is deposited on a surface of the base sheet where the letters or images are printed.

9. The forgery-preventing yarn according to claim 6, wherein an ink to be used for printing the letters or images is enabled to exhibit fluorescent property, phosphorescent property or ultraviolet-reflecting property.

10. The forgery-preventing yarn according to claim 8, wherein an ink to be used for printing the letters or images, the protective layer or an adhesive layer to be used for adhering the protective layer to the base sheet is enabled to exhibit fluorescent property, phosphorescent property or ultraviolet-reflecting property.

11. A forgery-preventing yarn comprising a flat forgery-preventing thread formed of a film comprising a base sheet comprising rayon and one or more letters or one or more images printed on the base sheet, the film being slit to have a width of 0.15 mm to 0.75 mm, wherein the flat forgery-preventing thread is twisted to a core thread/yarn;

wherein all of the letters or images printed on the base sheet are selected from a group of the letters or images depicted by only a straight line/straight lines which is/are parallel with, perpendicular to, or inclined by 45 degrees to the feeding direction of the base sheet on an occasion of printing the letters or images, or by a combination of these lines only.

12. The forgery-preventing yarn according to claim 11, wherein a protective layer is deposited on a surface of the base sheet where the letters or images are printed.

13. The forgery-preventing yarn according to claim 12, wherein an ink to be used for printing the letters or images is enabled to exhibit fluorescent property, phosphorescent property or ultraviolet-reflecting property.

14. The forgery-preventing yarn according to claim 12, wherein the protective layer or an adhesive layer to be used for adhering the protective layer to the base sheet is enabled to exhibit fluorescent property, phosphorescent property or ultraviolet-reflecting property.

* * * * *